US008402683B2

(12) United States Patent
Cabahug et al.

(10) Patent No.: US 8,402,683 B2
(45) **Date of Patent: *Mar. 26, 2013**

(54) RIFLE ACCESSORY RAIL, COMMUNICATION, AND POWER TRANSFER SYSTEM-BATTERY PACK

(75) Inventors: Eric F. Cabahug, Fairfax, VA (US); Joseph Frascati, Arlington, VA (US); Don McLaughlin, Ashburn, VA (US); James S. Dodd, Linden, VA (US); Ben Feldman, Reston, VA (US)

(73) Assignee: Prototype Productions Incorporated Ventures Two, LLC, Ashburn, VA (US)

( * ) Notice: Subject to any disclaimer, the term of this patent is extended or adjusted under 35 U.S.C. 154(b) by 63 days.

This patent is subject to a terminal disclaimer.

(21) Appl. No.: 12/689,438

(22) Filed: Jan. 19, 2010

(65) Prior Publication Data

US 2010/0275489 A1 Nov. 4, 2010

Related U.S. Application Data

(60) Provisional application No. 61/145,211, filed on Jan. 16, 2009.

(51) Int. Cl.
*F41C 23/00* (2006.01)

(52) U.S. Cl. ..... 42/85; 42/71.01; 42/72; 42/84; 42/75.03

(58) Field of Classification Search ..... 42/85, 71.01, 42/72, 84, 75.03

See application file for complete search history.

(56) References Cited

U.S. PATENT DOCUMENTS 4,533,980 A 8/1985 Hayes
5,033,219 A 7/1991 Johnson et al.
5,142,806 A 9/1992 Swan
5,360,949 A 11/1994 Duxbury
5,669,174 A 9/1997 Teetzel
5,822,905 A 10/1998 Teetzel
5,826,363 A 10/1998 Olson
6,237,271 B1 5/2001 Kaminski
6,618,976 B1 9/2003 Swan
6,622,416 B2 * 9/2003 Kim ..... 42/146
6,925,744 B2 * 8/2005 Kincel ..... 42/71.01
6,931,775 B2 8/2005 Burnett
7,144,830 B2 12/2006 Hill et al.
7,243,454 B1 * 7/2007 Cahill ..... 42/72
RE40,216 E 4/2008 Swan
7,421,818 B2 9/2008 Houde-Walter
7,464,495 B2 * 12/2008 Cahill ..... 42/72
7,525,203 B1 * 4/2009 Racho ..... 290/1 R
7,548,697 B2 6/2009 Hudson et al.
7,559,169 B2 7/2009 Hung et al.
7,562,483 B2 * 7/2009 Hines ..... 42/90
7,584,569 B2 9/2009 Kallio et al.
7,627,975 B1 12/2009 Hines
7,640,690 B2 * 1/2010 Hines ..... 42/75.03
7,676,975 B2 * 3/2010 Phillips et al. ..... 42/72
7,712,241 B2 5/2010 Teetzel et al.
7,818,910 B2 * 10/2010 Young ..... 42/71.01

(Continued)

OTHER PUBLICATIONS

In the US Patent and Trademark Office U.S. Appl. No. 12/689,430 Non-Final Office Action dated Feb. 17, 2011, 4 pages.

(Continued)

*Primary Examiner* — Michelle Clement
(74) *Attorney, Agent, or Firm* — Patton Boggs LLP

(57) ABSTRACT

The present invention is related to weapons systems. In particular, the present invention is directed to accessory attachment systems for rifles and small arms weapons that enable attached accessory devices to draw power from a central power source and communicate with the user and/or other devices.

10 Claims, 18 Drawing Sheets

U.S. PATENT DOCUMENTS

| | | | | |
|---|---|---|---|---|
| 7,841,120 | B2 | 11/2010 | Teetzel et al. | |
| 7,866,083 | B2 | 1/2011 | Teetzel | |
| 7,975,419 | B2 * | 7/2011 | Darian | 42/84 |
| 8,001,715 | B2 | 8/2011 | Stokes | |
| 2005/0241206 | A1 | 11/2005 | Teetzel et al. | |
| 2008/0010890 | A1 | 1/2008 | Vice et al. | |
| 2008/0039962 | A1 | 2/2008 | McRae | |
| 2008/0040965 | A1 | 2/2008 | Solinsky et al. | |
| 2008/0063400 | A1 | 3/2008 | Hudson et al. | |
| 2008/0134562 | A1 * | 6/2008 | Teetzel | 42/146 |
| 2008/0170838 | A1 | 7/2008 | Teetzel et al. | |
| 2008/0190002 | A1 * | 8/2008 | Hines | 42/1.06 |
| 2009/0044439 | A1 * | 2/2009 | Phillips et al. | 42/72 |
| 2009/0108589 | A1 * | 4/2009 | Racho | 290/1 R |
| 2009/0255160 | A1 * | 10/2009 | Summers | 42/70.01 |
| 2010/0031552 | A1 | 2/2010 | Houde-Walter | |
| 2010/0083553 | A1 | 4/2010 | Montgomery | |
| 2010/0192443 | A1 | 8/2010 | Cabahug et al. | |
| 2010/0192444 | A1 | 8/2010 | Cabahug et al. | |
| 2010/0192446 | A1 | 8/2010 | Darian | |
| 2010/0192448 | A1 | 8/2010 | Darian | |
| 2010/0218410 | A1 | 9/2010 | Cabahug et al. | |
| 2010/0242332 | A1 | 9/2010 | Teetzel et al. | |
| 2011/0000120 | A1 | 1/2011 | Thompson | |
| 2011/0010979 | A1 | 1/2011 | Houde-Walter | |
| 2011/0126622 | A1 | 6/2011 | Turner | |
| 2011/0162251 | A1 | 7/2011 | Houde-Walter | |
| 2011/0173865 | A1 | 7/2011 | Compton et al. | |

OTHER PUBLICATIONS

Third Party Submission by Michael B. Brooks dated May 12, 2011.
In the US Patent and Trademark Office U.S. Appl. No. 12/689,436 Non-Final Office Action dated Oct. 5, 2011, 4 pages.
In the US Patent and Trademark Office U.S. Appl. No. 12/689,437 Non-Final Office Action dated Oct. 6, 2011, 10 pages.
In the US Patent and Trademark Office U.S. Appl. No. 12/689,440 Non-Final Office Action dated Oct. 7, 2011, 10 pages.
In the US Patent and Trademark Office U.S. Appl. No. 12/791,460 Non-Final Office Action dated Oct. 6, 2011, 6 pages.
In the US Patent and Trademark Office U.S. Appl. No. 12/950,979 Non-Final Office Action dated Oct. 5, 2011, 11 pages.
In the US Patent and Trademark Office U.S. Appl. No. 13/075,837 Non-Final Office Action dated Dec. 20, 2011, 8 pages.
In the US Patent and Trademark Office U.S. Appl. No. 13/075,857 Non-Final Office Action dated Jan. 11, 2012, 10 pages.
In the US Patent and Trademark Office U.S. Appl. No. 13/075,880 Non-Final Office Action dated Dec. 22, 2011, 11 pages.

* cited by examiner

Pin and socket Connector

Pin and socket Connector

RIFLE ACCESSORY RAIL, COMMUNICATION, AND POWER TRANSFER SYSTEM-BATTERY PACK

CROSS-REFERENCE TO RELATED APPLICATIONS

This application is a Continuation-In-Part of U.S. patent application Ser. No. 12/689,439 filed on Jan. 9, 2010, title "Rifle Accessory Rail, Communication, And Power Transfer System—Power Distribution," which claims the benefit of U.S. Provision Patent Application No. 61/145,228 filed on Jan. 16, 2009, U.S. patent application Ser. No. 12/689,430 filed on Jan. 19, 2010, titled "Rifle Accessory Rail, Communication, And Power Transfer System," which claims the benefit of U.S. Provisional Patent Application No. 61/145,232 filed on Jan. 16, 2009; U.S. patent application Ser. No. 12/689,436 filed on Jan. 19, 2010, titled "Accessory Mount for Rifle Accessory Rail, Communication, And Power Transfer System—Accessory Attachment," which claims the benefit of U.S. Provisional Patent Application No. 61/145,216 filed on Jan. 16, 2009; U.S. patent application Ser. No. 12/689,437 filed on Jan. 19, 2010, titled "Rifle Accessory Rail, Communication, And Power Transfer System—Communication," which claims the benefit of U.S. Provisional Patent Application No. 61/145,248 filed on Jan. 16, 2009; U.S. patent application Ser. No. 12/689,438 filed on Jan. 19, 2010, titled "Rifle Accesory Rail, Communication, And Power Transfer System—Battery Pack," which claims the benefit of U.S. Provision Patent Application No. 61/145,211 filed on Jan. 16, 2009; and U.S. patent application Ser. No. 12/689,440 filed on Jan. 19, 2010, titled "Rifle Accessory Rail, Communication, And Power Transfer System—Rail Contacts," which claims the benefit of U.S. Provisonal Patent Application No. 61/145,222 filed on Jan. 16, 2009.

BACKGROUND OF THE INVENTION

The present invention is related to weapons systems. In particular, the present invention is directed to accessory attachment systems for rifles and small arms weapons that enable attached accessory devices to draw power from a central power source and communicate with the user and/or other devices.

The current rifles and small arm weaponry in use by US armed forces can be equipped with numerous combat optics, laser designators/sights, and flashlights; all comes with different power requirements and battery supplies. The result is a heavy weapon and a heavier field load of batteries to accommodate the various accessories, which ultimately impacts the soldiers' effectiveness, particularly on longer missions. One of the US Army focus areas is improving the performance of their soldiers' combat equipment while reducing the load that each soldier has to carry. One of these efforts is concentrated on providing advanced technologies to demonstrate the feasibility of an innovative communications rail and power transfer system. The resulting system will be backwards compatible with current mission support devices and accessories that mount to small arms weapons during operational procedures and it will reduce the overall weight penalties of the current system.

SUMMARY OF THE INVENTION

It is an object of the present invention to obviate or mitigate the disadvantages of previous firearm accessory rails.

In a first embodiment of the present invention, there is provided a firearm accessory mounting rail for attachment of a firearm accessory to the barrel of a firearm. The accessory rail is for providing a connection for the firearm accessory.

One embodiment of the present invention provides an accessory attachment system for rifles and small arms weapons that enables attached accessory devices to draw power from a central power source and communicate with the user or other devices without exposed wires.

Other aspects and features of the present invention will become apparent to those ordinarily skilled in the art upon review of the following description of specific embodiments of the invention in conjunction with the accompanying figures.

DETAILED DESCRIPTION OF THE INVENTION

For simplicity and illustrative purposes, the principles of the present invention are described by referring to various exemplary embodiments thereof. Although the preferred embodiments of the invention are particularly disclosed herein, one of ordinary skill in the art will readily recognize that the same principles are equally applicable to, and can be implicated in other compositions and methods, and that any such variation would be within such modifications that do not part from the scope of the present invention. Before explaining the disclosed embodiments of the present invention in detail, it is to be understood that the invention is not limited in its application to the details of any particular embodiment shown, since of course the invention is capable of other embodiments. The terminology used herein is for the purpose of description and not of limitation. Further, although certain methods are described with reference to certain steps that are presented herein in certain order, in many instances, these steps may be performed in any order as may be appreciated by one skilled in the art, and the methods are not limited to the particular arrangement of steps disclosed herein.

One of the US Army focus areas is improving the performance of their warfighters' combat equipment while reducing the load that each warfighter has to carry. One of these efforts is concentrated on providing advanced technologies to demonstrate the feasibility of an innovative communications rail and power transfer system. The resulting system will be backwards compatible with current mission support devices and accessories that mount to small arms weapons during operational procedures and it will reduce the overall weight penalties of the current system.

Rifle Buttstock

Figure 1:
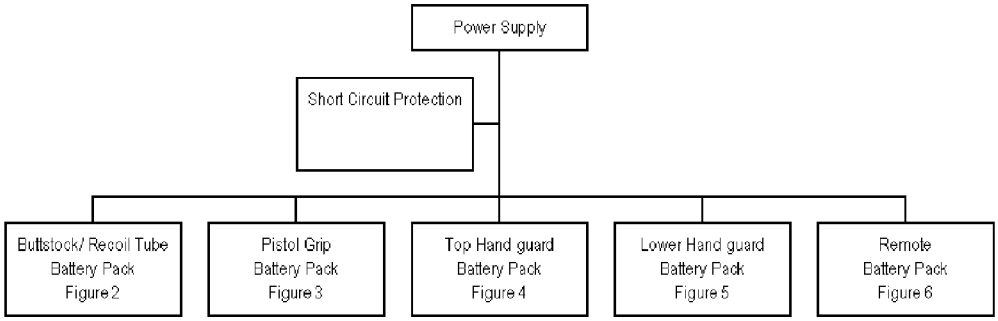
FIG. 1 provides a diagrammatical representation of the embodiments of the present invention.
Figure 2:
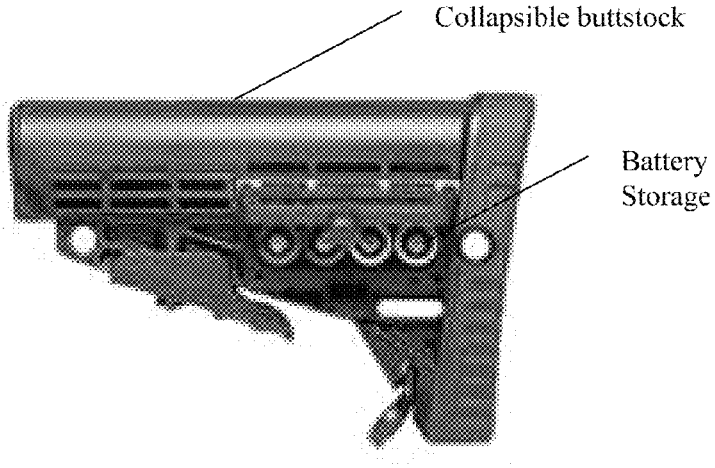
FIG. 2 shows a spare battery storage compartment within a rifle a butt stock.

There are several commercial butt stock products that take advantage of available space within and around the buttstock assembly. FIG. 2 below shows a spare battery storage compartment within the collapsible butt stock. This space could be enlarged without interfering with the functionality of the stock. The disadvantage of the battery pack location is the power line path and transitions to the Picatinny Rails. A coiled cable maybe used to transition it from the collapsible stock and to the upper receiver then to the hand guard rails.

Figure 3A:
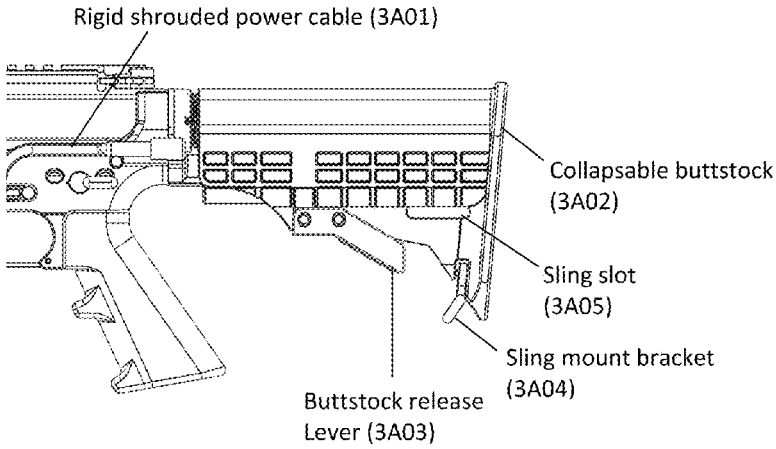
FIGS. 3A-3K and 3M-3O show particular embodiments of the present invention.

The present invention provides a means to incorporate the battery pack into the buttstock/recoil tube shown in FIG. 3A in the fully collapsed mode. This method eliminates the need of a cumbersome coiled cable as previously mentioned which would allow a protected transition from the power cable into the accessory rails. The electrical wire connection is housed inside a durable and impact resistant rigid polymer shroud (3A01) that conforms along the side of the lower receiver. The shroud is securely mounted and retained by quick connect/disconnect pivot and takedown pins as well as the bolt release roll pin or trigger/hammer pins. In the section where the cable wire transitions between the foregrip and lower receiver at the forward end of hinge pivot pin, a flexible metallic conduit is used to protect the cable as it crosses over and terminates onto the foregrip electrical connection.

The collapsible buttstock (3A02) is formed with a single molded polymer material and contains an interior cavity to accommodate the battery pack, buffer tube/extension receiver, mounting provision for the release lever (3A03), sling bracket (3A04) and sling slot (3A05) so the rifle can be carried using a sling.

The collapsible buttstock is mounted similar to the existing system which is supported by the buffer tube/extension receiver and is connected to the lower receiver of the rifle on which the collapsible buttstock is mounted.

Buttstock/Buffer Tube Battery Pack

Figure 3B:
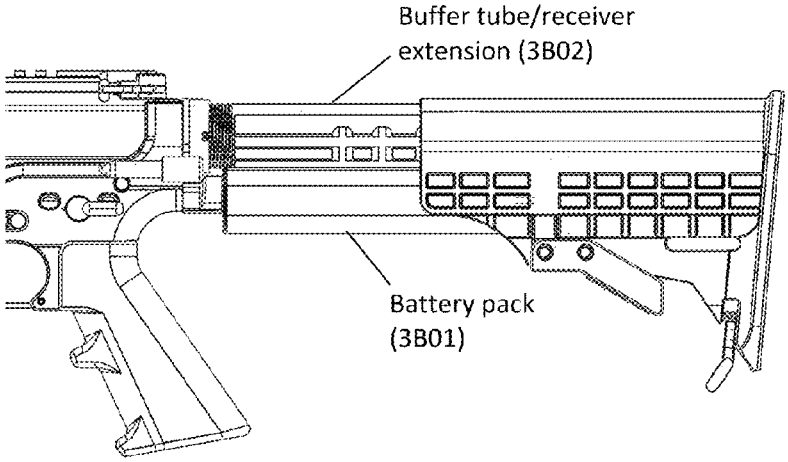

A buttstock/buffer tube battery pack assembly includes a collapsible buttstock, locking and quick release mechanism and a removable battery pack. The buttstock provides a compartment on the underside of the buffer tube assembly which allows the battery pack to be installed and withdrawn for removal through the rear of the rifle. The battery pack mounts on the buffer tube independent of the buttstock which telescopes along the rifle. The buttstock is collapsible and can be extended in various multiple intermediate positions providing an adjustable overall length of the firearm. FIG. 3B shows the battery pack (3B01) and the Buffer tube/receiver extension (3B02).

Figure 3C:
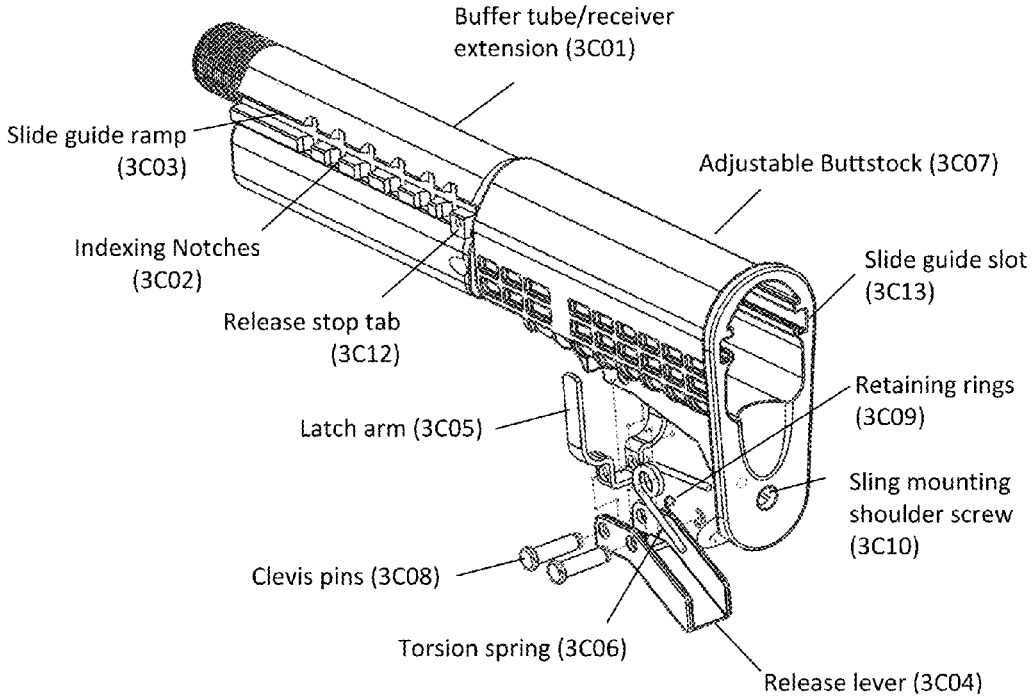

The buttstock has locking and quick release mechanisms, shown in FIG. 3C that have the ability to lock onto the buffer tube/receiver extension (3C01) in multiple positions providing the adjustable length of the rifle. The mechanism includes indexing notches (3C02) and a slide guide ramp (3C03) which extends along the length of the buffer tube/receiver extension (3C01). The mechanism utilizes a release lever (3C04), a latch arm (3C05), a torsion spring (3C06) that is mounted into the buttstock (3C07) and held together with clevis pins (3C08) and retaining rings (3C09).

The mechanism is transversely mounted into the buttstock (3C07) in a manner that interfaces with the latch arm (3C05) and indexing notches (3C02). The indexing notches (3C02) have at least six preset settings, as the release lever (3C04) is pulled to disengage the latch arm (3C05) interface which slides away from the indexing notch (3C02) interface. This setting allows free adjustment of the buttstock (3C07) until stopped by the release stop tab (3C12) and guided by the slide guide slot (3C13). When the release lever (3C04) is released, the torsion spring (3C06) forces the latch arm (3C05) into position which automatically engages into the interfaces of the indexing notches (3C02) and locks the buttstock (3C07) into position. A sling mount may be attached using sling mount shoulder screw (3C10).

Figure 3D:
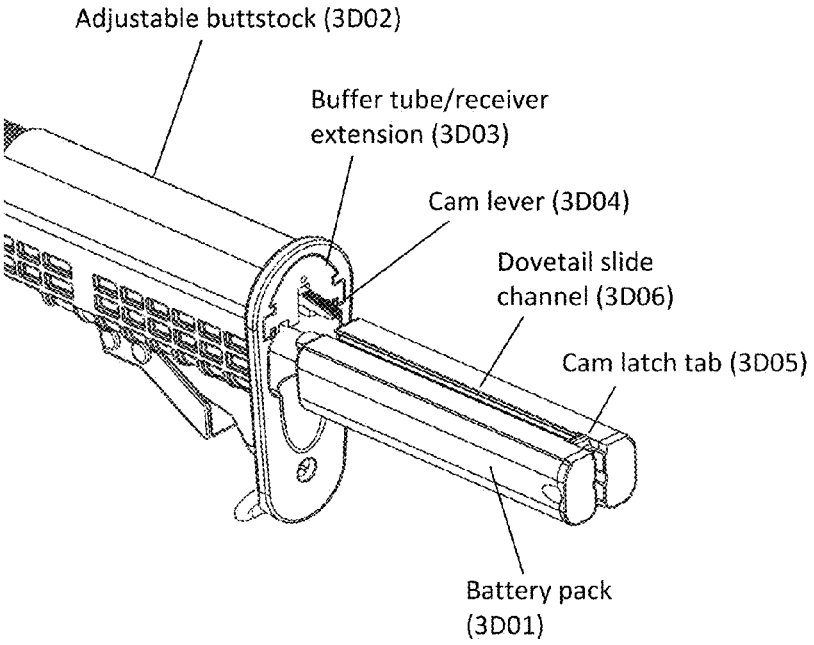

The location of the battery pack within the buttstock provides the most advantageous location. This location offers functional advantages toward the overall balance, usability, and ergonomics of the rifle. Additionally the location provides a convenient method of replacing and charging the batteries. As shown in FIG. 3D, to install the battery pack (3D01), the buttstock (3D02) is collapsed onto the base of the buffer tube/receiver extension (3D03) and the cam lever (3D04) is moved into an upright position, releasing the cam latch tab (3D05) and allowing the battery pack (3D01) to slide along the dovetail slide channel (3D06).

Figure 3E:
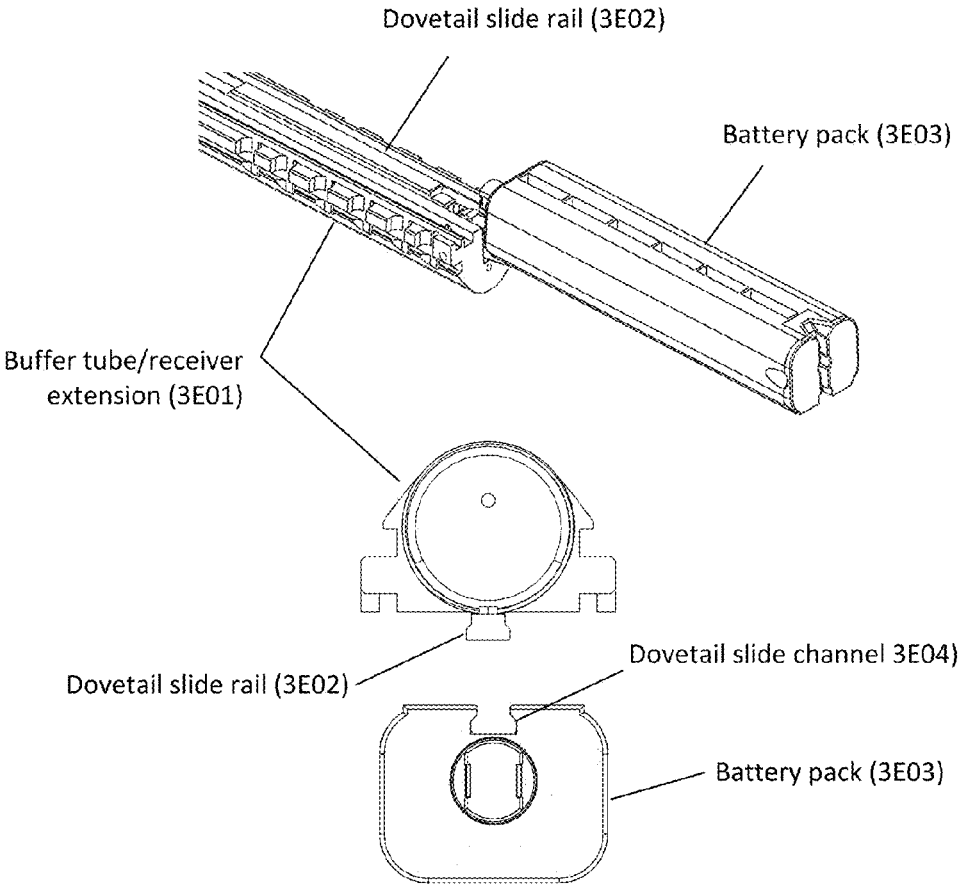
Figure 3F:
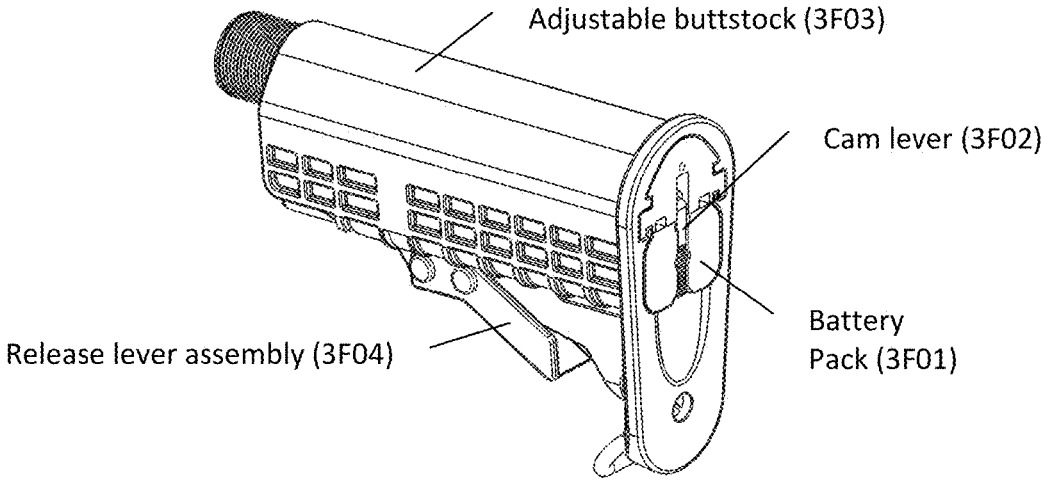

FIG. 3E depicts how the buffer tube/receiver extension (3E01) has a dovetail slide guide rail (3E02) that extends longitudinally and the battery pack (3E03) has a mating dovetail slide channel (3E04). When the battery pack is inserted onto the buttstock compartment it aligns and hooks with the mating dovetail slide guide rail shown in FIGS. 3D and 3E. As depicted in FIG. 3F, the battery (3F01) is pushed through the buttstock (3F03) longitudinally until the cam latch tab engages with the cam lever (3F02). The final closing will be when the cam lever (3F02) is pushed down flush which in turn pushes the tab on the housing and drives the battery pack home. At this position the battery pack is fully connected and in locked down position while the buttstock (3F03) can telescope independently to different positions as controlled by the release lever assembly (3F04).

Figure 3G:
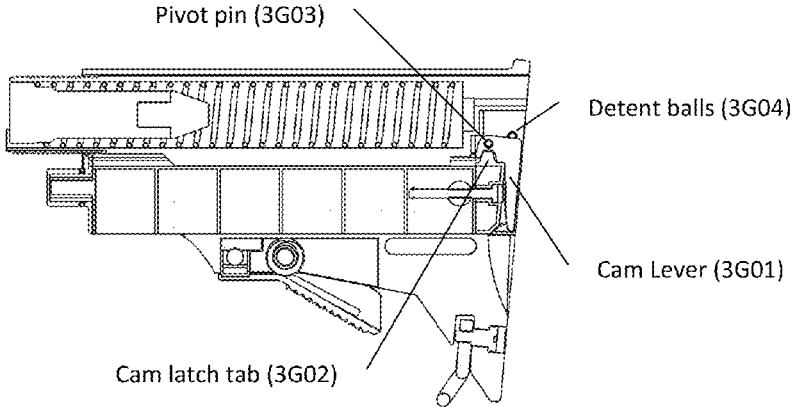

The cam assembly shown in FIG. 3G is made up of 4 components: cam lever (3G01), cam latch tab (3G02), pivot pin (3G03) and detent balls (3G04). The cam lever (3G01) is mounted in the buffer tube/receiver extension and can rotate freely along the pivot pin (3G03). The detent ball (3G04) arrangement will temporarily hold the cam lever (3G01) in a preset position relative to installation of the battery pack and when the battery pack is assembled it will provide a lock to prevent accidental opening. The installation and removal of the battery pack is made quick, easy and secure by simply lifting and pushing the cam lever (3G01).

Figure 3H:
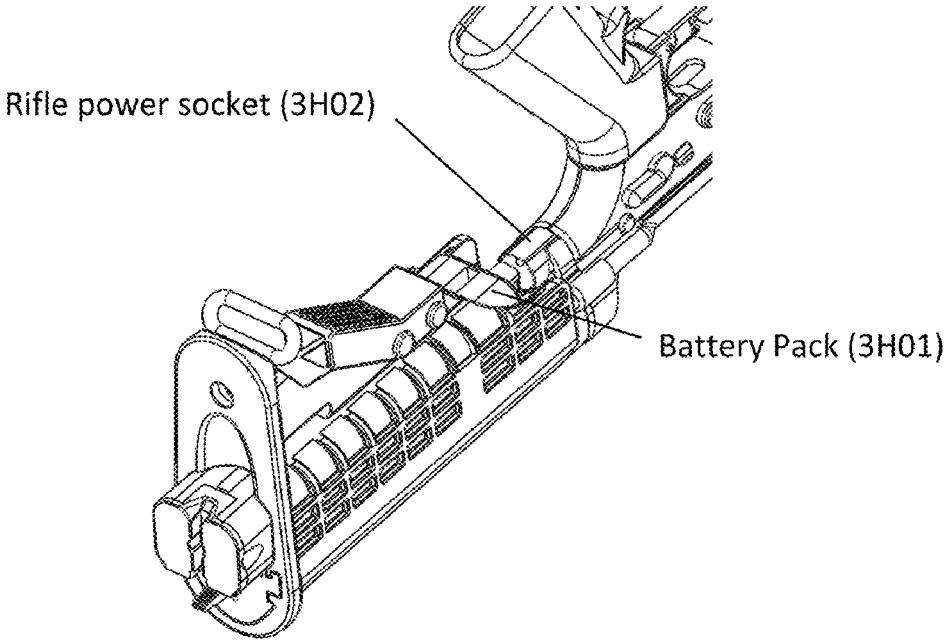
Figure 3I:
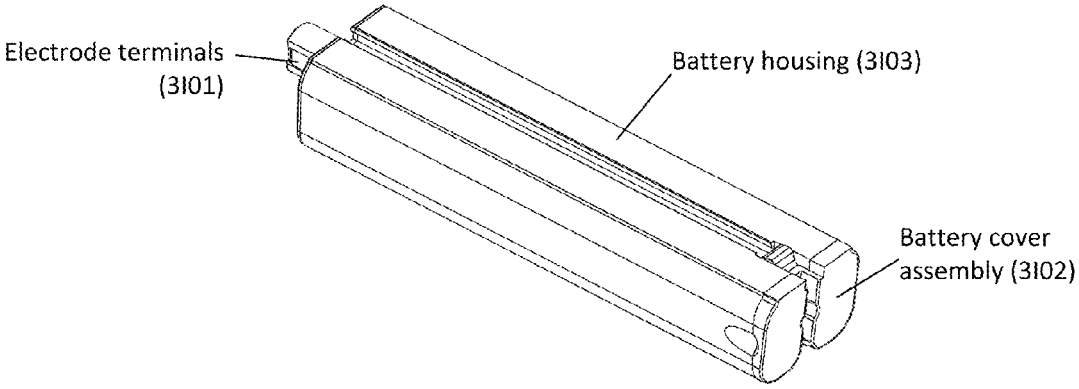

The battery compartment for the batteries must be able to securely hold the batteries under severe environmental conditions such as vibration, shock and underwater. The battery pack (3H01) shown in FIG. 3H and detailed in FIG. 3I is designed to connect to the rifle power socket (3H02) over a long period and severe conditions without causing power failure due to defective contact. The battery pack (3H01) was also designed to make replacing batteries an easy task without using special tools.

Figure 3J:
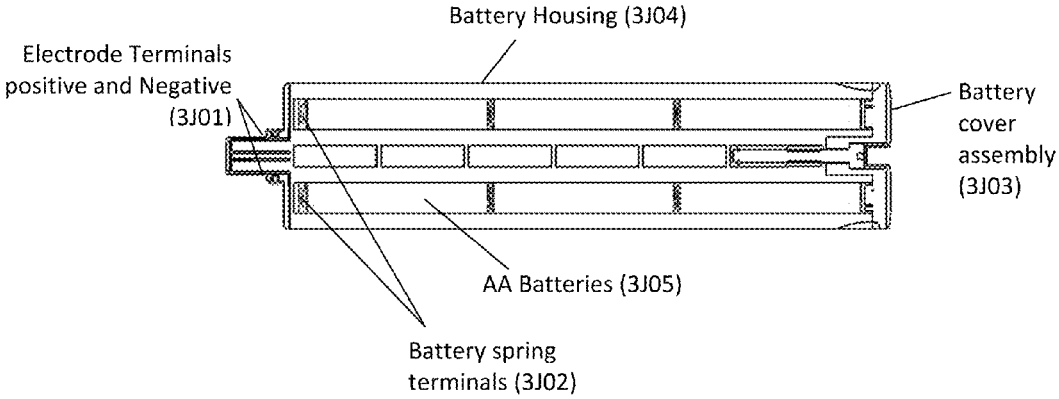
Figure 3K:
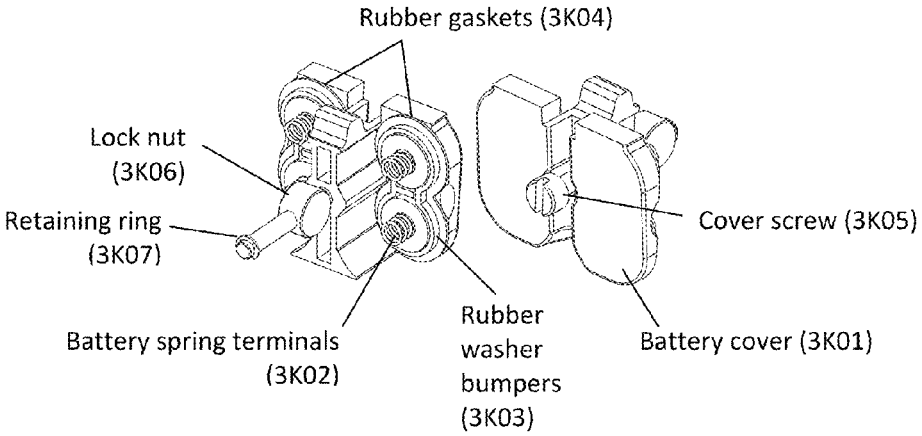
Figures 3M, 3N, 3O:
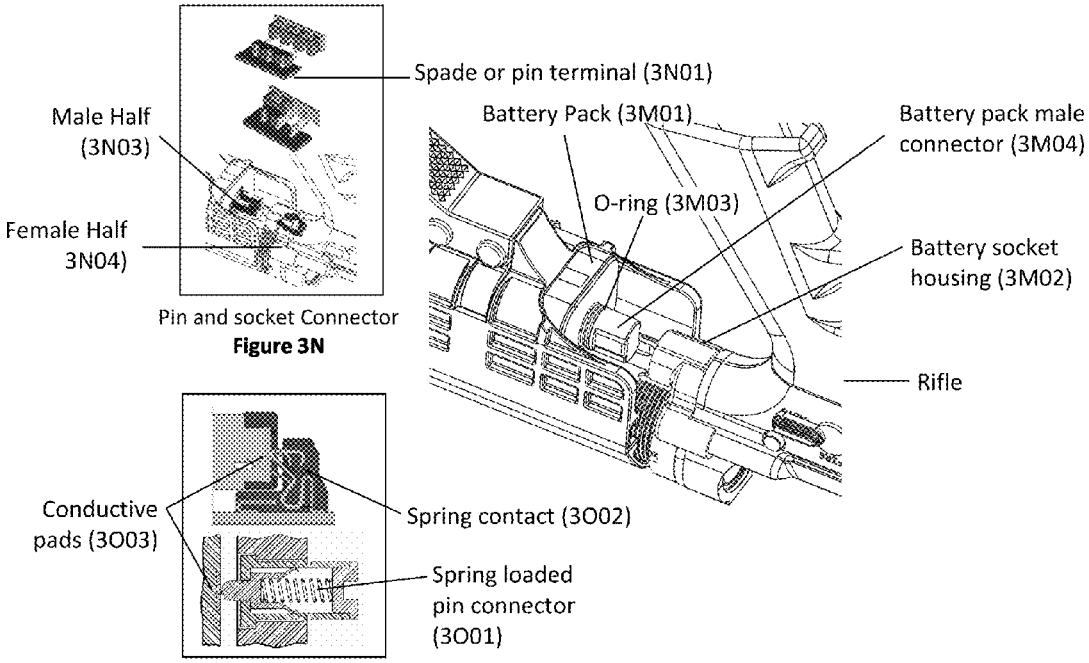

The battery pack assembly in shown FIG. 3I and FIG. 3J consists of a pair of exposed positive/negative electrode battery terminals (3I01 and 3J01), internal battery spring terminals (3J02), a removable battery cover (3I02 and 3J03) and battery housing compartment (3I03 and 3J04). The housing is fabricated of weather resistant and resilient materials such as plastics and is shaped to accept standard size AA batteries (3J05). The mating battery cover in FIG. 3K consists of battery cover (3K01), spring terminals (3K02), rubber washer bumpers (3K03), rubber o-ring gaskets (3K04) and cover screw mechanism (3K05) which opens and closes the battery compartment into a watertight compartment and securely holds the batteries under repeated shock of the rifle buttstock. The cover screw mechanism (3K05) includes a threaded screw which extends through the battery cover and a threaded locking nut (3K06) having an internal mount feature on the battery housing. The battery cover assembly can securely swivel away from the opening of the battery housing to allow batteries to be replaced, while retained by the retaining ring (3K07). FIG. 3M is a view that illustrates the attachment structure to make a battery pack (3M01) connect with battery socket housing. The battery pack is inserted into the socket housing (3M02) which simultaneously accommodates the battery pack male connector (3M04) and o-ring seal (3M03) into the socket housing (3M02). This arrangement enables the battery pack to be electrically connected and securely sealed with the rifle.

The attachment structure of the spring contact connector can accommodate several configurations shown in FIG. 3N and FIG. 3O such as spring loaded pin connector (aka pogo pin) (3O01), spring compression connector (3O02) and spring spade (3N01) or round pin/socket connector. The connector assembly includes a male-half connector (3N02) that has an array of male contacts and a female-half (3N04) connector has an array of contact regions positioned in matching arrangement to the array of the male contact or conductive pads (3O03).

Pistol Grip

Figure 4:
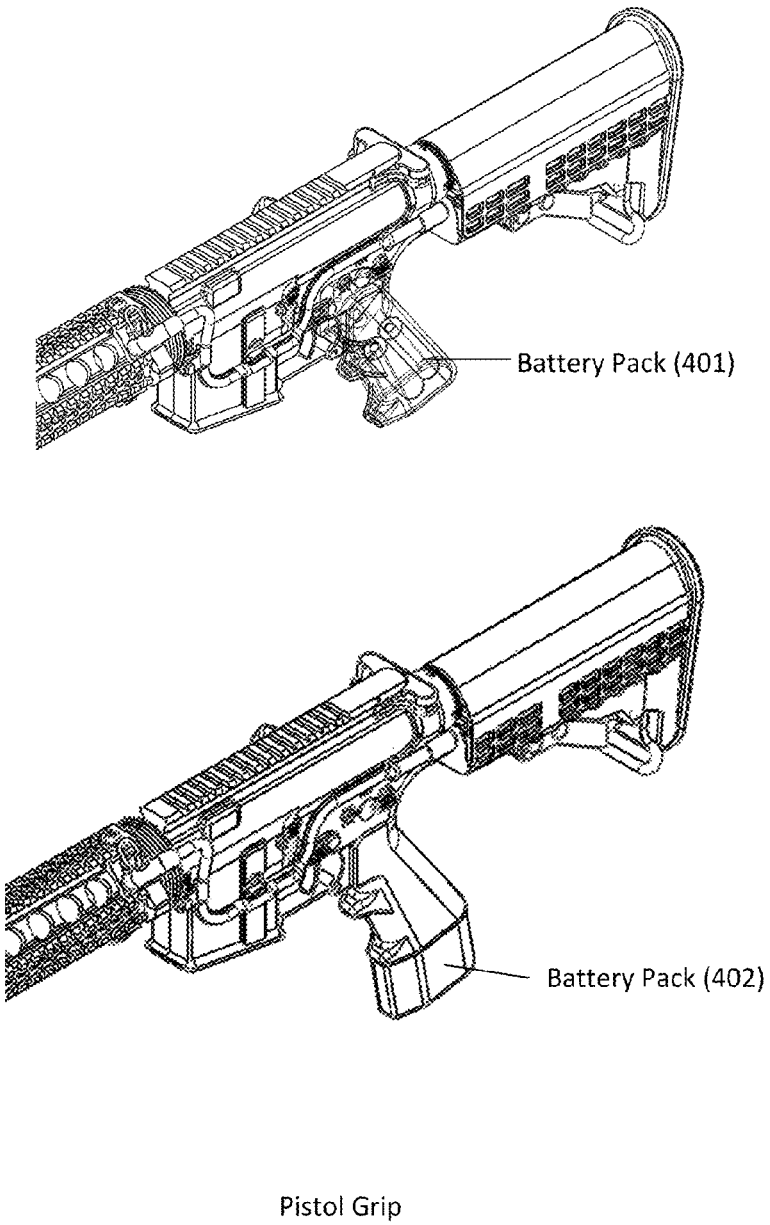
FIG. 4 shows a particular embodiment of the present invention.

The second method for the power source is in Pistol Grip shown in FIG. 4. The configuration is similar to the removable battery pack (401) and (402) for a cordless drill. This position allows for ease of use while providing some limited balancing effect for the weapon. As with the Butt Stock location, the Pistol Grip has the disadvantage of requiring transitions from the Lower Receiver, to the Upper Receiver, and then to the Fore Grip. An advantage of this approach is the similarity of operation to an ammunition magazine, ejected and loaded with a vertical motion. This ease of replacement could allow a smaller battery to be used, facilitating change out during longer missions.

Handguard Fore Grip

Figure 5:
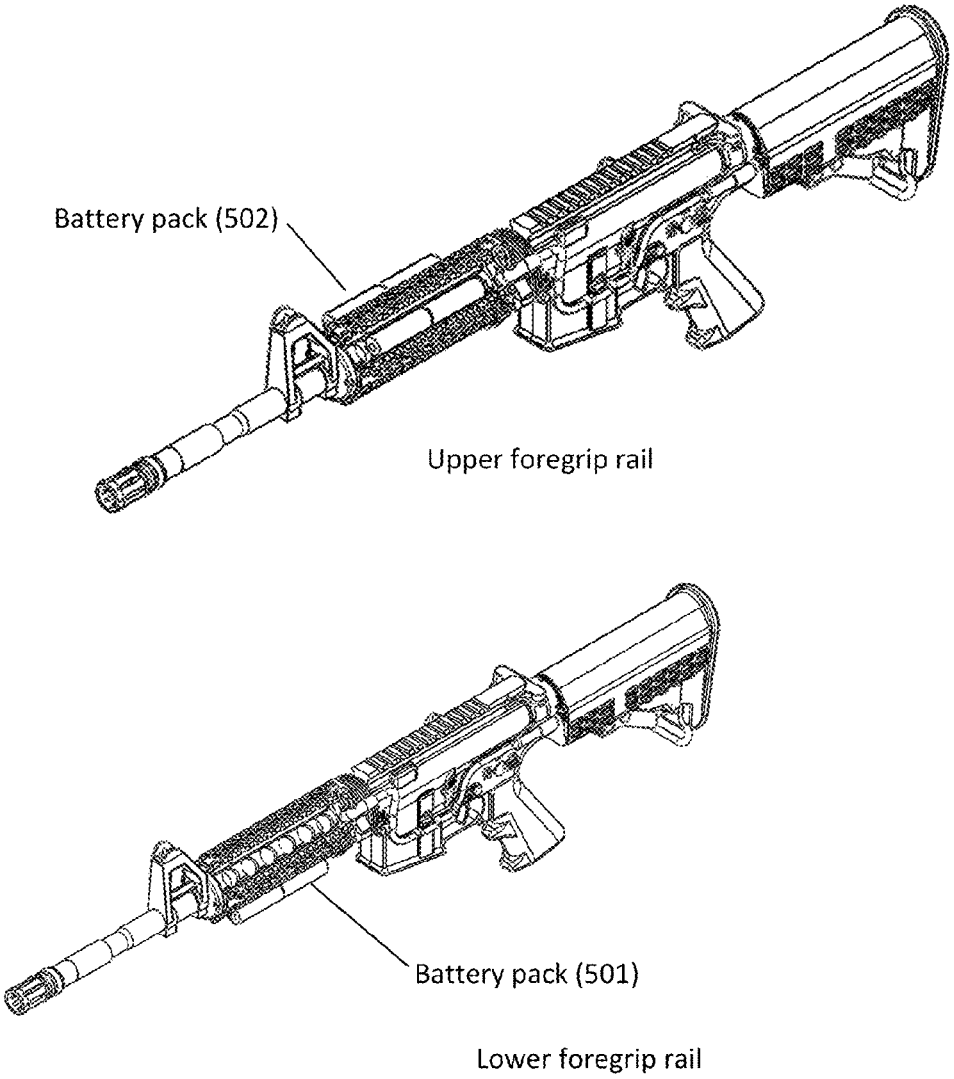
FIG. 5 shows a particular embodiment of the present invention.

The third method of powering the rifle is to mount the battery pack in the Fore Grip. The present invention provides several methods of mounting the battery pack in this position, examples of which are shown in FIG. 5. One of the methods has the battery pack (501) designed to fit into a mount that replaces the lower Fore Grip. A Picatinny Rail may be incorporated into the case design allowing for continued use of the lower Fore Grip as a mounting location. This design has a drawback, in that, the M203 Grenade launcher is mounted in place of the lower Fore Grip, thus removing the battery pack. One solution is to load the battery pack into the pistol grip of the new Grenade launcher. This method would supply power to the carbine's rails through the new model in a similar method as locating the battery pack in the M4's pistol grip.

The second method is to mount the battery pack (502) on the top Fore Grip. The Fore Grip would be redesigned to allow for two battery packs to fit between the top and side rails. This option allows for a universal mounting location that does not interfere or complicate mounting of the accessories to the Fore Grip.

Handguard Universal Placement

Figure 6:
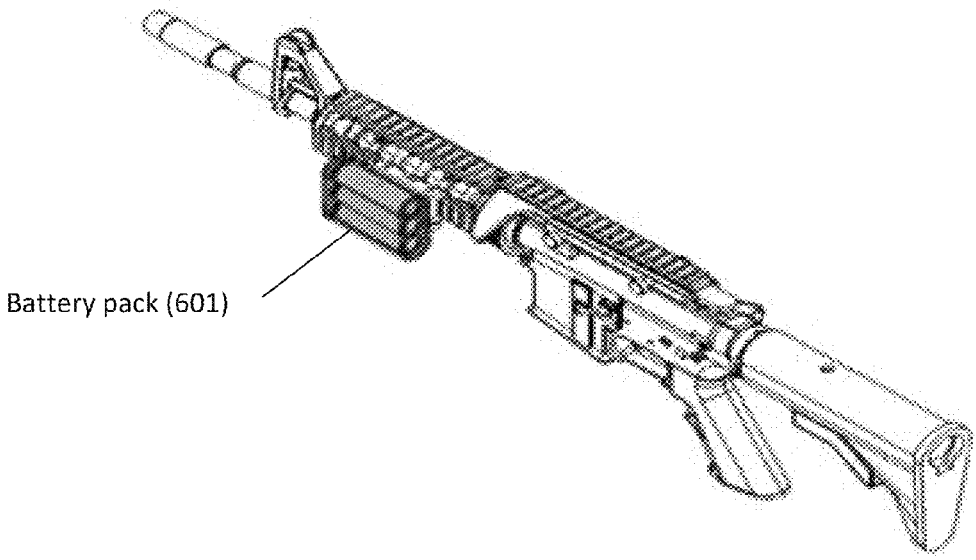
FIG. 6 shows a particular embodiment of the present invention.

A fourth method to mounting the battery pack is a design that attaches to the Picatinny Rails shown in FIG. 6. This battery pack design allows the unit to be attached at any point on the powered Rails adding flexibility of the battery position. The battery pack case (601) would integrate a Rail Grabber similar to the designs of the accessory rail mounts but instead of receiving power the pack would deliver power to the Rails.

External Power Pack

Figure 7:
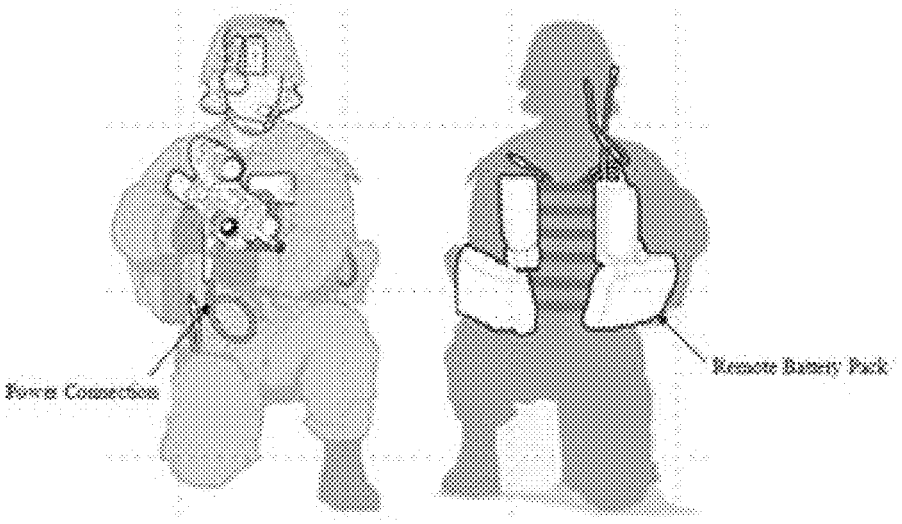
FIG. 7 shows a particular embodiment of the present invention.

A fifth method of attachment is through an external battery power source as shown in FIG. 7 which would be connected to the weapon via cable.

Batteries

Meeting the needs of present and future Land warrior has been one military's greatest challenges. Soldier requirements for power are changing as fast as new electronics are being developed. In addition to radio communications and computers, a myriad of equipment such as weapon accessories; laser-designator, night vision scopes, electronic optical gun sights, sensors and etc. requires portable power which are critical to soldier combat effectiveness.

Primary batteries now provide the main energy source, but the acquisition, storage, distribution, and disposal of over hundred different types poses logistical challenges in the battlefield. New technologies have at the same time increased the number of and variety of power-driven functions that require the soldier to carry increasing amounts of portable power. The army has recognized that it must approach equipping dismounted soldier from integrated system vantage. The concept of the soldier as system led the army to look for system solutions which would combine electronics, weapon and power source in a single ensemble.

Most primary battery technologies are very mature, but there are several systems that might be improved to the point where they could have a significant impact on the military. Primary batteries are used until fully discharged and then must be discarded.

Fuel cells which are in various stages of development can be used to replace batteries as well as to supplement batteries in a hybrid system. Fuel cells are currently under intense research and development as power sources for a range of applications, including portable power, automobiles, and large-scale power plants in the future.

Secondary batteries can be recharged. There are numerous commercially available secondary batteries that are used commercially, such as lead-acid, silver-zinc, and metal hydride systems. There are systems that have advanced technologically since the late 90's; including Li-ion and Li polymer chemistries, nickel metal hydride, and lithium sulfur. Li-ion batteries encompass several different chemistries, including LiCoO2, LiNiO2, and LiMn2O4 positive electrodes. Secondary batteries have quickly captured the consumer electronic market such as digital cameras, camcorders, cell phones, and notebook computers, etc.

Use of disposable batteries in training and field operations has proven to be substantially expensive. Employment of rechargeable batteries for many applications promises to reduce life cycle cost. Fueled hybrid and energy harvesting solutions offer even greater promise in reducing weight for longer missions. These have operational advantages and limitations but add logistical task to be carry recharging platform in forward battlefield.

These and other embodiments will be apparent to those of skill in the art, all within the scope of the present invention, which is defined solely by the claims appended hereto.

What is claimed is:

1. A Weapons Accessory Power Distribution System for providing a supply of electrical power for use by one or more power-consuming accessories operatively associated with a weapon, comprising:

a receiver extension attached at a distal end of a receiver of a weapon and containing a mechanical feature formed along a length thereof;

a power source mounted on said receiver extension by the interconnection of a mechanical feature on the power source with the mechanical feature of the receiver extension;

a latch mounted on said receiver extension to lock said power source on said receiver extension; and an adjustable buttstock containing an aperture formed along a length thereof which aperture encloses the receiver extension and the attached power source and which provides a slideable attachment of said adjustable butt stock to said receiver extension, for positioning said adjustable butt stock at one of a plurality of predetermined positions on said receiver extension.

2. The Weapons Accessory Power Distribution System of claim 1 wherein said adjustable buttstock is collapsible and can be extended in various multiple intermediate positions.

3. The Weapons Accessory Power Distribution System of claim 1, further comprising:

electrical contacts mounted on said distal end of said receiver; and electrical contacts formed on said power source for mechanically and electrically engaging said electrical contacts mounted on the distal end of said receiver.

4. The Weapons Accessory Power Distribution System of claim 1 wherein said power source mounts on said receiver extension independent of the adjustable buttstock which telescopes along the receiver extension.

5. A Weapons Accessory Power Distribution System for providing a supply of electrical power for use by one or more power-consuming accessories operatively associated with a weapon, comprising:

a receiver extension attached at a distal end of a receiver of a weapon and containing a mechanical feature formed along a length thereof;

a power source mounted on said receiver extension by the interconnection of a mechanical feature on the power source with the mechanical feature of the receiver extension, comprising:

a battery compartment that holds at least one battery, wherein said battery compartment comprises a substantially cylindrical housing with a spring loaded cover; and an adjustable buttstock containing an aperture formed along a length thereof which aperture encloses the receiver extension and the attached power source and which provides a slideable attachment of said adjustable buttstock to said receiver extension, for positioning said adjustable buttstock at one of a plurality of predetermined positions on said receiver extension.

6. The Weapons Accessory Power Distribution System of claim 5 wherein said battery compartment and said spring loaded cover form a watertight container for batteries loaded therein.

7. The Weapons Accessory Power Distribution System of claim 1 wherein said power source mechanical feature comprises a dovetail slide guide rail that mates with said receiver extension mechanical feature which comprises a dovetail slide channel.

8. The Weapons Accessory Power Distribution System of claim 1 wherein said power source is slideably attached to said receiver extension.

9. The weapons accessory power distribution system of claim 5 wherein said power source mechanical feature comprises a dovetail slide guide rail that mates with said receiver extension mechanical feature which comprises a dovetail slide channel.

10. The weapons accessory power distribution system of claim 5 wherein said power source is slideably attached to said receiver extension.

* * * * *